US010196198B1

(12) United States Patent
Ahlborn et al.

(10) Patent No.: US 10,196,198 B1
(45) Date of Patent: Feb. 5, 2019

(54) STACKED ARTICLE RETRIEVAL APPARATUS

(71) Applicant: Kleen Test Products Corporation, Port Washington, WI (US)

(72) Inventors: William T. Ahlborn, Daytona Beach Shores, FL (US); Jeffrey G. Maxon, Waldo, WI (US); Douglas J. Arnold, Franklin, WI (US); Mark A. Oman, Belgium, WI (US); Linnea L. Esberg, Port Washington, WI (US); Keith S. Everson, Hartford, WI (US); Greg W. Gierach, Sussex, WI (US); Kelly R. Effert, Pewaukee, WI (US)

(73) Assignee: Kleen Test Products Corporation, Port Washington, WI (US)

( * ) Notice: Subject to any disclaimer, the term of this patent is extended or adjusted under 35 U.S.C. 154(b) by 0 days.

(21) Appl. No.: 15/667,731

(22) Filed: Aug. 3, 2017

(51) Int. Cl.
*B65H 3/00* (2006.01)
*B65D 83/08* (2006.01)
*B65B 25/14* (2006.01)

(52) U.S. Cl.
CPC ..... *B65D 83/0811* (2013.01); *B65B 25/145* (2013.01)

(58) Field of Classification Search
CPC ..... B65D 83/0811; B65B 25/145
USPC ..... 221/37, 210, 220
See application file for complete search history.

(56) References Cited

U.S. PATENT DOCUMENTS 2,588,152 A * 3/1952 Newman ..... B42D 3/12 221/199
3,207,360 A * 9/1965 Scott ..... A47K 10/423 221/48
3,266,665 A * 8/1966 Eakens ..... A47K 10/423 221/48
4,905,870 A * 3/1990 Mamolou ..... A47J 31/08 221/210
5,097,984 A * 3/1992 Meisner ..... A47J 31/08 221/210
5,540,354 A * 7/1996 Annand ..... A47K 10/423 206/449
5,810,200 A * 9/1998 Trokhan ..... A47K 10/421 221/55
6,273,293 B1 * 8/2001 Carlson ..... A47J 31/08 221/210
6,412,656 B1 * 7/2002 Placik ..... A47K 10/421 221/33
7,934,597 B2 * 5/2011 Zwick ..... B65D 83/0894 206/233
8,210,393 B1 * 7/2012 Nasrallah ..... A47K 10/423 221/38
8,245,876 B2 * 8/2012 Gehring ..... B65D 83/0811 221/37
8,425,393 B2 * 4/2013 Cheich ..... B31D 5/0043 206/494
8,631,968 B2 * 1/2014 Taylor ..... A47K 10/422 221/36

(Continued)

*Primary Examiner* — Michael Collins
(74) *Attorney, Agent, or Firm* — Boyle Fredrickson, S.C.

(57) ABSTRACT

A lid for use with a container including stacked articles configured to facilitate the removal of an uppermost article from the stacked articles. The lid includes a grabbing apparatus configured to adhere to the uppermost article of the stacked articles and a grabbing apparatus platform configured to support the grabbing apparatus that is extendible allowing extension of the grabbing apparatus from the lid.

16 Claims, 9 Drawing Sheets

(56) References Cited

U.S. PATENT DOCUMENTS

| | | | | |
|---|---|---|---|---|
| 9,414,721 | B2 * | 8/2016 | Marin-Quintero | A47K 10/44 |
| 2005/0269343 | A1 * | 12/2005 | Gao | B65D 83/0805 221/63 |
| 2006/0266758 | A1 * | 11/2006 | Lewis | B65H 1/04 221/33 |
| 2012/0187140 | A1 * | 7/2012 | Nasrallah | A47K 10/423 221/1 |
| 2015/0108157 | A1 * | 4/2015 | Marin-Quintero | A47K 10/44 221/55 |
| 2016/0022098 | A1 * | 1/2016 | Yamada | B65D 83/08 221/63 |

* cited by examiner

STACKED ARTICLE RETRIEVAL APPARATUS

BACKGROUND

The present application relates to a container and lid for enclosing a stack of articles and facilitating removal of a single article from the stack of articles enclosed in the container. More particularly, the present application relates to a container and lid enclosing stacked articles where the lid includes a grabbing apparatus to facilitate removal of a single article from the stacked articles.

It is known to provide jars or other containers including stacks of articles where the user is intended to remove a single article for use. Examples include facial tissues, make up removal pads, skin cleansing pads, note paper, etc. In order to remove a single article from the stack of articles, containers have utilized a number of different approaches including, for example, specially formed apertures, adhesives attached to a container lid or opening flap, nested overlapping folds in articles where removal of an article prepares a subsequent article for removal in an aperture, and a container design to facilitate access to the stack of articles.

One type of article that is enclosed in this type of container is pads that have been specially treated to perform a specific function. The treatment typically includes a liquid solution that is absorbed and retained with each article of the stack of articles. Examples including disposable cleaning pads, medicated pads, etc. Removing this type of article from a small container can be difficult. Further, it is desirable to avoid inserting fingers into the container to avoid the possibility of contamination of the remaining articles.

Additionally, liquid permeated articles can be more difficult to separate or present other difficulties when adhering individual articles from the stack of articles. For example, an adhesive attached to a container lid or opening is less effective at securing an article when the article is permeated with a liquid solution. According to another example, when an article draws a subsequent article through an aperture, the portion of the article that is drawn through the aperture is subjected to evaporation and contamination, reducing the effectiveness of the article.

U.S. Pat. No. 5,046,640 seeks to solve the issue described above by securing hook tape, specifically VELCRO, on the underside of the lid of the container. This patent describes allowing removal of an uppermost pad by turning over a container then removing the lid and having a single pad affixed to the inside for convenient access. However, the inventors for the present application recognized that hook tape is most effective with a sliding action. Further, the inversion is less effective with the stack of articles gets shorter and the stack is most likely to rotate or not have enough weight to adhere the uppermost article to the hook tape. Also, inverting the container can coat the underside of the lid with the liquid solution, creating problems when the container is opened.

The '640 patent further describes an aftermarket device that also uses hook tape where the hook tape is secured to a handle that can be inserted into the container to adhere the uppermost pad. However, the inventors for the present application recognized that customers dislike having to purchase an aftermarket product and we concerned about the possibility of losing the device. Further, when a device is repeatedly used and also stored separately from the container, this also increases the risk of contamination.

What is needed is an apparatus and method for facilitating retrieval of an article from an article stack housed within a container. What is further need is such an apparatus integrally formed with a component of the container.

SUMMARY OF THE INVENTION

The present invention provides a container and lid where the lid includes an integral grabbing apparatus allowing a user to secure an uppermost article from a stack of articles contained in the container. The invention further describes using hook tape on the grabbing apparatus to adhere to the uppermost article of the stack of articles. Advantageously, integrating the grabbing apparatus in the container lid allows the user to secure the uppermost article without reaching into the container, tipping over the container, and/or risking loss of the grabbing apparatus.

Specifically, the present invention provides a lid for use with a container including stacked articles configured to facilitate the removal of an uppermost article from the stacked articles. The lid includes a grabbing apparatus configured to adhere to the uppermost article of the stacked articles and a grabbing apparatus platform configured to support the grabbing apparatus that is extendible allowing extension of the grabbing apparatus from the lid.

It is thus a feature of at least one embodiment of the invention to provide for such a lide where the grabbing apparatus platform includes an extendible bellows. In one such embodiment, the grabbing apparatus is positioned at a center position of the extendible bellows. In another embodiment, the extendible bellows is formed from thermoplastic elastomers. The extendible bellows can also be configured to allow extension of the grabbing apparatus to a distance correlate to a height of the container The lid may alternatively be configured such that the grabbing apparatus platform includes at least a first telescoping arm extendible from a retaining clip integrally formed retaining clip in the lid. The grabbing apparatus platform may also include a second telescoping arm to increase the amount of extension.

Another embodiment of the invention relates to a lid for use with a container including stacked articles configured to facilitate the removal of an uppermost article from the stacked articles. The lid includes a lid body, a grabbing apparatus platform integrally formed within the lid body that is extendible from a first position proximate the lid body to a second position distal from the lid body, and a grabbing apparatus affixed to a portion of the grabbing apparatus platform that is farthest removed from the lid body in the second position and configured to adhere to the uppermost article of the stacked articles.

Yet another embodiment of the invention relates to a hermetically sealed container and lid assembly configured to facilitate the removal of an uppermost article from an article stacked housed within the container. The assembly includes a container body including a container base and at least one container wall and a lid configured to form a hermetic seal with the container when in a closed position. The lid includes a lid body, a grabbing apparatus platform integrally formed within the lid body that is extendible from a first position proximate the lid body to a second position distal from the lid body, and a grabbing apparatus affixed to a portion of the grabbing apparatus platform that is farthest removed from the lid body in the second position and configured to adhere to the uppermost article of the stacked articles.

These particular features and advantages may apply to only some embodiments falling within the claims and thus do not define the scope of the invention.

DETAILED DESCRIPTION OF AN EXEMPLARY EMBODIMENT

Figure 1:
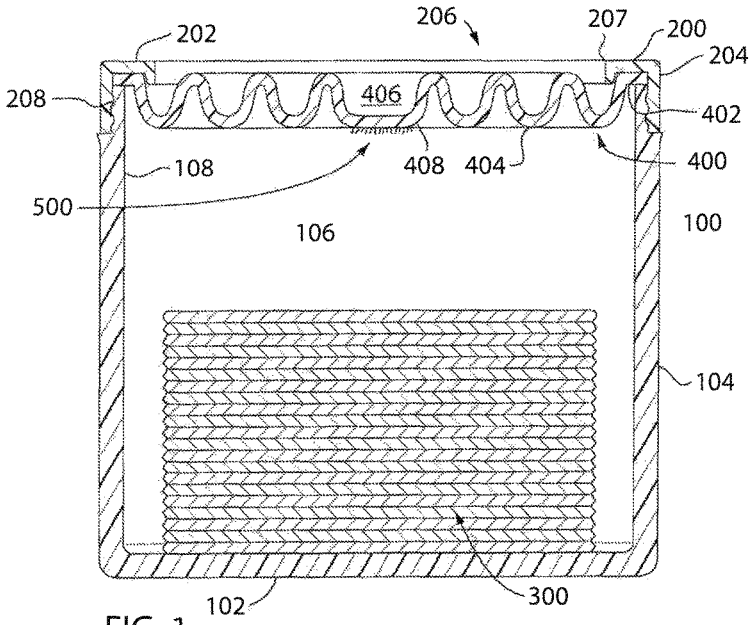
FIG. 1 is a cross sectional view of a container and lid where the lid includes an integrated grabbing apparatus, according to an exemplary embodiment.

Referring now to FIG. 1, a container 100 and lid 200 enclosing an article stack 300 is shown, according to an exemplary embodiment. Container 100 and lid 200 may form a hermetic seal when in a closed position to prevent leakage and/or evaporation of the contents of container 100.

According to an exemplary embodiment, container 100 includes a roughly circular base 102 having a diameter of approximately 2 and ¾ inch. Container 100 further includes a sidewall 104 extending upward from the base 102 approximately 5 inches. Base 102 and sidewalls 104 define a container cavity 106.

Container 100 may be formed using an injection molded plastic having a substantially consistent wall thickness in the base 102 and sidewalls 104. The injection molded plastic may be configured to be functionally inert to liquid solutions contained in the container cavity 106.

Depending on the contents of the container cavity 106, container 100 may formed from materials associated with a greater or lesser degree of sterility. For example, container 100 may be formed from another material such a glass. Container 100 may further be configured to include a lining (not shown) to preserve the integrity of the article stack 300 in the container cavity 106.

According to exemplary embodiment, sidewall 104 is configured to include a sidewall screw threaded portion 108 at an end of the sidewalls 104 distal from base 102. Container screw thread portion 108 is configured to mate with a corresponding lid screw thread portion 208, described below. Container screw thread portion 108 and lid screw thread portion 208 are configured to securely hold lid 200 to container 100 to create a hermetic seal of container cavity 106. Dependent on the shape of the container 100 and base 102, container 100 may include a plurality of container walls 104, one for each side on the base 102.

According to an exemplary embodiment, lid 200 includes a roughly circular top 202 having a diameter substantially correlated to the diameter of base 102. Lid 200 further includes a sidewall 204 extending downward from the top 202 approximately 1 inch. Top 202 and sidewalls 204 are configured to be removably affixed to container 100 to completely enclose the container cavity 106 when in a closed position as depicted in FIG. 1. Accordingly to an alternative embodiment, lid 200 may be permanently affixed or integrally formed with container 100.

Lid 200 may similarly be formed using an injection molded plastic having a substantially consistent wall thickness in the top 202 and sidewalls 204. The injection molded plastic may also be configured to be functionally inert to liquid solutions contained in the container cavity 106. Alternatively, lid 200 may be formed from another material such a stamped steel ring. Container 100 may further be configured to include a lining (not shown) to preserve the integrity of the article stack 300 in the container cavity 106.

Base 102, sidewalls 104, and container cavity 106 may be configured based upon the dimensions of the article stack 300 to be contained within container cavity 106. Accordingly, where the article stack 300 is a stack of square articles, base 102 may be configured to be a square base and container 100 would be configured to include four sidewalls 104 extending upward therefrom.

Although container 100 and lid 200 are shown and described above as being affixed to one another using screw threads 108 and 208, container 100 and lid 200 may be affixed to each other using a variety of other methods. For example, lid 200 may be affixed to container 100 in a hinged configuration, such that when closed, lid 200 "snaps" onto container 100 based on affixing structure formed in one or both of container 100 and lid 200. Using such a hinged configuration, lid 200 would remain affixed to container 100, even in an open position. Depending on the nature of articles within article stack 300, container 100 and lid 200 may be require to form a hermetical seal when in a closed position, independent of the particular structure used to affix lid 200 to container 100.

Article stack 300 may be any type and/or configuration of stacked articles. In one exemplary embodiment, article stack 300 may be a stack of medicated pads that have been treated with a liquid solution including the medication. The medicated pads in article stack 300 may be a non-woven material configured to absorb and retain a portion of the liquid solution.

Figure 2A:
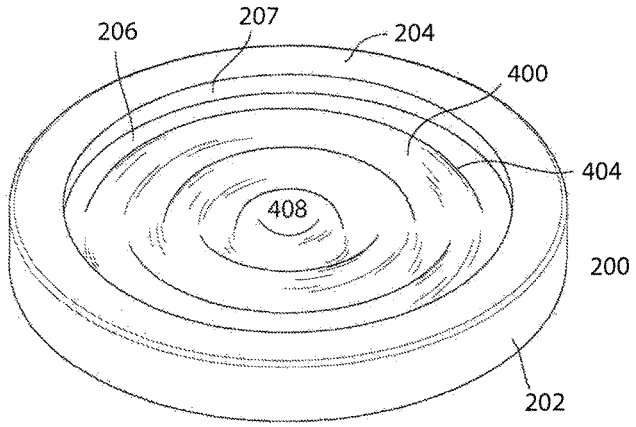
FIGS. 2A and 2B are partial isometric views of the lid of FIG. 1 depicting an extendible bellows grabbing apparatus in first and second positions, according to an exemplary embodiment.
Figure 2B:
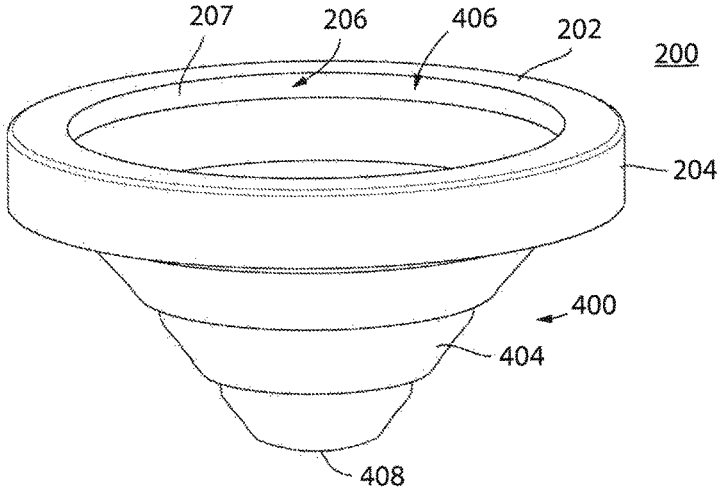

Referring now also to FIGS. 2A and 2B, according to one exemplary embodiment shown in FIGS. 1-4, lid 200 defines a lid opening 206 within the top 202. The diameter of the lid opening 206 is less than the diameter of the lid 200. Lid opening 206 may included a reinforced ring 207 integrally formed in the top 202 and having a thickness greater than the thickness of the top 202. Reinforced ring 207 is configured define lid opening 206 and allow access to an extendible bellow 400, described in further detail below. Reinforced ring 207 is configured to provide additional structural integrity to lid 200, to define and provide unrestricted access to extendible bellows 400, as described in further detail below, and to provide additional support for securing extendible bellows 400 to lid 200.

Extendible bellows 400 is configured to be sandwiched between container 100 and lid 200 when the 200 is in the closed position. According to an exemplary embodiment, extendible bellows 400 includes a lid adhesion platform 402, a bellows portion 404, a digit receiving portion 406, and an article grabbing apparatus platform 408. Extendible bellows 400 may be formed by an injection molding process. Extendible bellows 400 may be formed using thermoplastic elastomers (TPE), consisting of materials having both thermoplastic and elastomeric properties.

Lid adhesion platform 402 may be a broad flat surface having a diameter extending from the inside of lid screw threaded portion 208 to the outermost portion of reinforced ring 207. Lid adhesion platform 402 may be permanently affixed to lid 202 such that when lid 200 is removed from container 100, extendible bellows 400 is similarly removed. Alternatively, lid adhesion platform 402 may be held in place to an underside of top 202 by a retaining lip integrally formed in lid sidewalls 204 (not shown). According to an exemplary embodiment, lid adhesion platform 402 may be configured to be the portion of extendible bellows 400 that is sandwiched between container 100 and lid 200 when in the closed position to hermetically seal container cavity 106.

Figure 3:
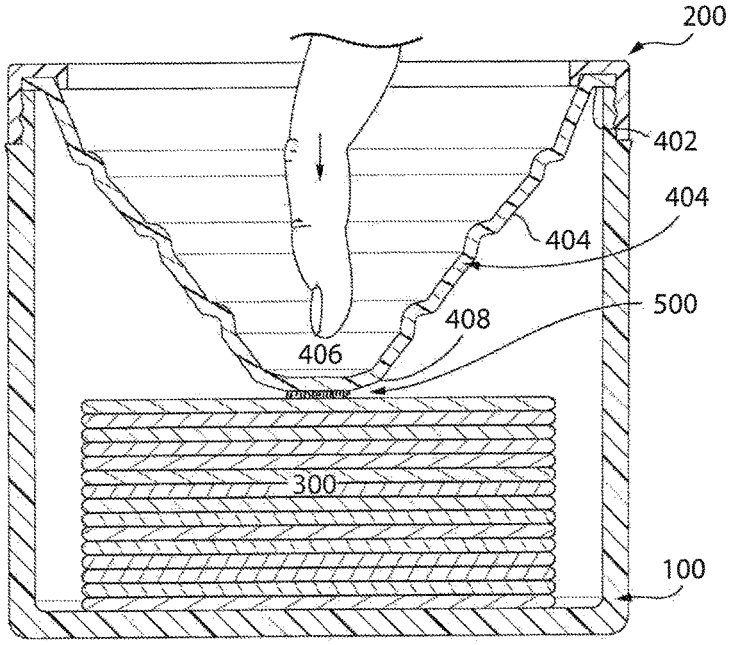
FIG. 3 is a cross sectional view of the container and lid in a closed position showing deformation of an extendible bellows, according to an exemplary embodiment.

A bellows portion 404 may be configured to include a plurality of integrally formed nested bellows rings configured to allow deformation of extendible bellows 400 into container 100 as described in detail below with reference to FIG. 3. Bellows portion 404 may be configured such that the range of deformation facilitated by the integrally formed bellows rings corresponds to the height of sidewalls 104. FIG. 2A shows extendible bellows 400 in a non-deformed state while FIG. 2B shows extendible bellows 400 in a deformed state.

Digit receiving platform 406 may be a flat portion of extendible bellows 400 positioned in the center of the extendible bellows 400. The diameter of the digit receiving platform 406 may be roughly correlated to the size of an average human fingertip. Positioning digit receiving platform 406 in the center of the extendible bellows 400 allows maximum travel of the article grabbing apparatus platform 408 towards the base 102 based on the deformation of the bellows portion 404. Digit receiving platform 406 may be positioned to be outside of the container cavity 106 when lid 200 and container 100 are in a closed position.

Article grabbing apparatus platform 408 may similarly be a flat portion of extendible bellows 400 positioned in the center of the extendible bellows 400. The diameter of the article grabbing apparatus platform 408 may also be roughly correlated to the size of an average human fingertip. Article grabbing apparatus platform 408 may be positioned on the opposite side of bellows 400 from digit receiving platform 406 and positioned to be inside of the container cavity 106 when lid 200 and container 100 are in a closed position.

Grabbing apparatus 500 may be any apparatus configured to adhere to an uppermost article of article stack 300 when brought into contact with article stack 300. According to an exemplary embodiment, grabbing apparatus 500 is hook tape, such as VELCRO. Alternatively, grabbing apparatus 500 may be a hook, an adhesive, or any other implementation configured to grab and retain the uppermost article of article stake 300 when the apparatus 500 interacts with the stack 300.

According to an exemplary embodiment, extendible bellows 400 may be configured to allow lateral movement of grabbing apparatus 500 when bellows portion 404 is in a deformed state. Accordingly, when a user has pushed their digit on platform 406 to bring grabbing apparatus 500 and contact with article stack 300, the user may initiate a side to side motion, moving apparatus 500 back and forth between sidewalls 104 to increase the degree of adhesion between the uppermost article of article stack 300 and grabbing apparatus 500 and further to separate the uppermost article from the article stack 300. For example, wherein grabbing apparatus 500 includes hook tape, allow lateral movement of the hook tape increases the number of hooks adhering to the nonwoven fabric of an uppermost article, facilitating separation of the uppermost article from the article stack 300 when extendible bellows 400 is returned to a non-deformed state and/or lid 200 is removed from container 100.

Grabbing apparatus 500 may be permanent affixed to grabbing apparatus platform 408 using an adhesive such as glue. Alternatively, grabbing apparatus 500 may be integrally formed with grabbing apparatus platform 408.

Bellows portion 404 may be configured such that the non-deformed state of the extendible bellows 400 is as shown in FIG. 1, with the digit receiving platform 406 being proximate to lid opening 206. Accordingly, referring now also to FIG. 3, bellows portion 404 is configured to allow deformation of extendible bellows 400 when a user positions their finger on the digit receiving portion 406 and applies force towards the base 102 of container 100 when lid 200 is in the closed position. When force is applied, article grabbing apparatus platform 408 is moved towards article stack 300 to bring a grabbing apparatus 500, described in further detail above, in contact with an uppermost article of article stack 300. When the force is removed, extendible bellows 400 may be configured to automatically return to the non-deformed state.

According to an alternative embodiment, the bellows portion 404 may be formed such that bellows portion 404 will remain in a deformed state even after force is no longer being applied to the digit receiving portion 406. The deformed state may be maintained by forming bellows portion 404 from locking nested bellows rings, by using more rigid materials that tend to retain the shape their place in this application of force, etc.

Advantageously, including extendible bellows 400 within lid 200 allows a user to apply force to bring the grabbing apparatus 500 into contact with the article stack 300 to grab an uppermost article from the article stack 300. Advantageously, elastomeric properties of extendible lows 400 allows operation of the grabbing apparatus 500 independent of the height of the article stack 300 within container cavity 106. Further, extendible bellows 400 allows the user to bring grabbing apparatus 500 and contact with the article stack 300 without turning over, shaking, or otherwise manipulating the container 100 in a manner that would disrupt the article stack 300 and/or coat the underside of lid 200 with the liquid solution contained within container cavity 106.

Figure 4A:
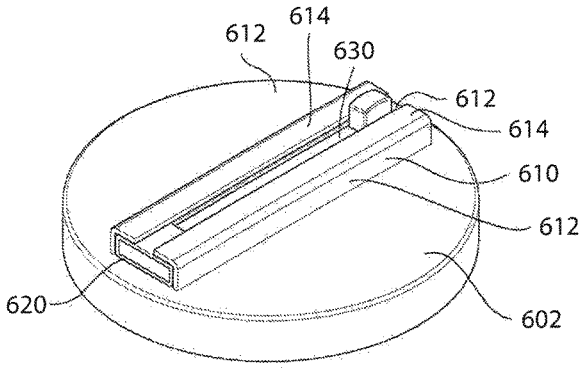
FIGS. 4A-4B are partial isometric views of an alternative embodiment of the lid of FIG. 1 depicting a telescoping arm grabbing apparatus in first and second positions, according to an exemplary embodiment.
Figure 4B:
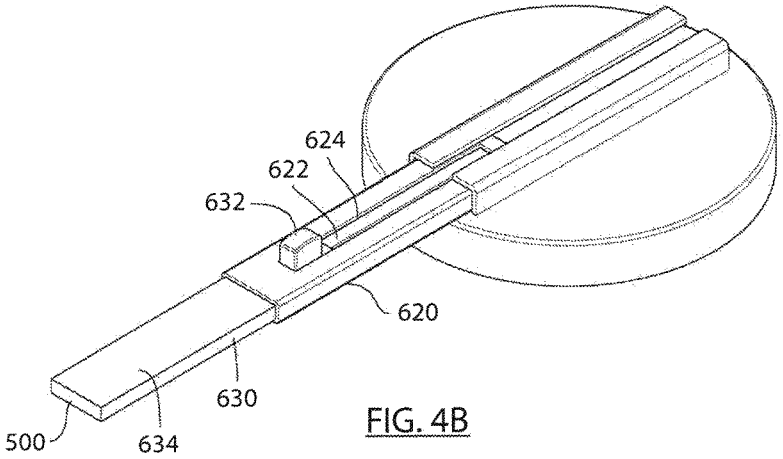

Referring now to FIGS. 4A-4B, an alternative embodiment of a lid 600 for container 100 including an integral grabbing apparatus configured to be external to the container cavity 106 is shown, according to an exemplary embodiment. The lid 600 includes a grabbing apparatus retaining clip 610, a nesting telescoping arm 620, and a nested telescoping arm 630. According to an alternative embodiment, lid 600 may be configured to include only grabbing apparatus retaining clip 610 and nested telescoping arm 430, depending on the lengths of clip 610 and arm 630 relative to the length of sidewalls 104 and accordingly, the depth of container 100. [Note that I marked up an earlier version of the lid with telescoping members again because of the dark background issue, but I would mark up the document marked real FIGS. 4A and 4B for filing]

Grabbing apparatus retaining clip 610 may be integrally formed extending upwardly from a top side 602 of lid 600, opposite the side of lid 600 affixed to container 100. Grabbing apparatus retaining clip 610 may be formed such that the opening is provided on the top side 602 lid 600, preserving the ability of lid 600 to hermetically seal the container cavity 106.

Retaining clip 610 may be configured to have a length approximately equal to the diameter of lid 600. Advantageously, providing a retaining clip 610 matching the diameter of the lid 600 increases the length that may be provided for a nesting telescoping arm 620 and nested telescoping arm 630 and, correspondingly, the depth of container 100 that may be provided without interfering with the use of the grabbing apparatus.

Retaining clip 610 may be formed by injection molding of a relatively rigid material configured to retain and protect telescoping arms 620 and 630. Retaining clip 610 includes right and left sidewalls 612 extending upward from the top side 602 of lid 600. Retaining clip 610 further includes right and left top walls 614 and top wall end portion 616. The length of sidewalls 612 is configured to roughly correlate to the height of nesting telescoping arm 620. Retaining clip 610 further includes a plurality of extension stops 618 affixed to the ends of sidewalls 612 and right and left top walls 614 opposite top wall end portion 616.

In operation, retaining clip 610 is configured to affix nesting telescoping arm 620 and nested telescoping arm 630 to lid 600. Retaining clip 610 includes at least one open sidewall allowing extension of telescoping arms 620 and 630 from a position between sidewalls 612 to a position substantially outside of sidewalls 612. Retaining clip 610 is configured to allow lateral movement of telescoping arms 620 and 630 in a direction parallel to the plane of top side 602. Extension stops 618 are configured to prevent telescoping arms 620 and 630 from sliding completely out of retaining clip 610.

Nesting telescoping arm 620 is a rectangular plastic slide configured to roughly correlate in size with the opening created by sidewalls 612 and top walls 614 of retaining clip 610. Nesting telescoping arm 620 is configured to slide from a position internal to retaining clip 610 to a position substantially external to retaining clip 610. Nesting telescoping arm 620 is configured to include one or more slide stops to prevent telescoping arm 620 from sliding completely outside of retaining clip 610.

Nesting telescoping arm 620 defines an arm opening 624 configured to receive nested telescoping arm 630. Nesting telescoping arm 620 further includes an opening 622 configured to allow a grabbing apparatus extension button 632, described in further detail below, to extend therethrough and slide along the length of nesting telescoping arm 620.

Nested telescoping arm 630 is a rectangular plastic slide configured to roughly correlate in size with the arm opening 624 of nesting telescoping arm 620. Grabbing apparatus extension button 632 may be integrally formed with nested telescoping arm 630 on a side opposite top side 602 of lid 600. Nested telescoping arm 630 is also configured to include one or more slide stops (not shown) to prevent telescoping arm 630 from sliding completely outside of telescoping arm 620.

Nested telescoping arm 630 is further configured to include grabbing apparatus 500 on an end 634 of the telescoping arm 630 allowing the greatest displacement of apparatus 500 from retaining clip 610. Grabbing apparatus 500 may be a piece of hook tape affixed to the end 634 of telescoping arm 630, may be a hook integrally formed in end 634, or any other apparatus configured to adhere end 634 to an uppermost article of the stack of articles 300.

Figures 5A, 5B, 5C:
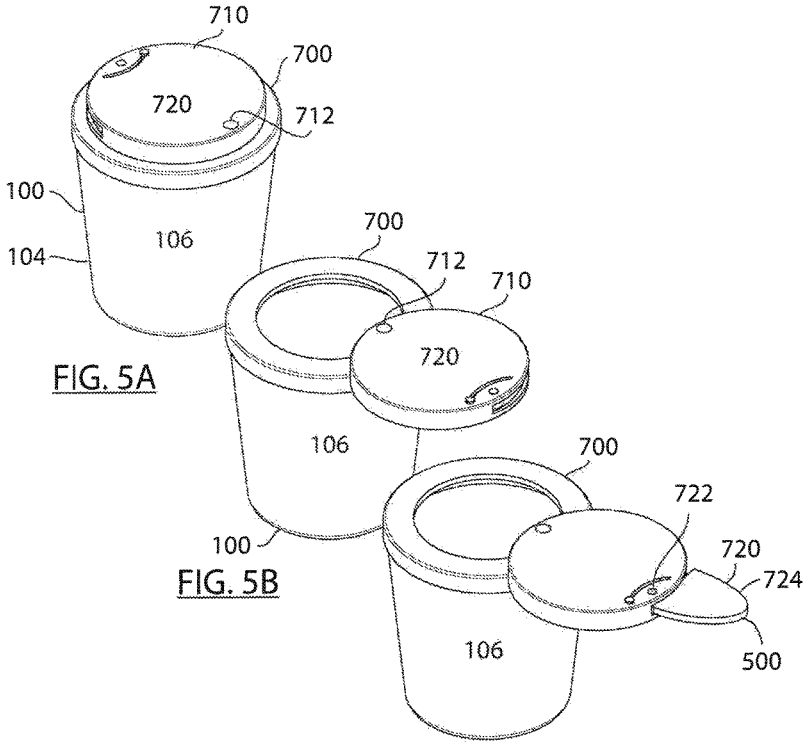
FIGS. 5A-5C are partial isometric views of another alternative embodiment of the lid of FIG. 1 depicting a pivoting grabbing apparatus in first, second and third positions, according to an exemplary embodiment.

Referring now to FIGS. 5A-5C, another alternative embodiment of a lid 700 for container 100 including an integral grabbing apparatus configured to be external to the container cavity 106 is shown, according to an exemplary embodiment. The lid 700 and includes a rotating arm 710, and a nested telescoping arm 720. According to an alternative embodiment, lid 700 may be configured to include only nested telescoping arm 720, depending on the length of arm 720 relative to the length of sidewalls 104 and accordingly, the depth of container 100.

Rotating arm 710 may be configured to have a pivot point 712, positioned proximate to an outer edge of lid 700. Pivot point 712 is configured to anchor rotating arm 710 to lid 700 and allow rotating arm 710 to pivot from a closed position in which an distal end of rotating arm 710 which distal from pivot point 712 is over lid 700 to an open position in which the distal end of rotating arm 710 is positioned extended from the lid 700. Pivot point 712 may be a pin extending through rotating arm 710 to an anchoring point formed in lid 700 (not shown).

Nested telescoping arm 720 may be included within rotating arm 710 and configured to rotate along with rotating arm 710 around pivot point 712. Nested telescoping arm 720 is an injection formed rectangular plastic slide configured to nest within rotating arm 710. A grabbing apparatus extension button 722 may be integrally formed with nested telescoping arm 720 on a side of nested telescoping arm 720 proximate to the pivot point 712. Accordingly, manipulation of grabbing apparatus extension button 722 allows extension of nested telescoping arm 720 from a position within rotating arm 710 to a position extended from rotating arm 720. Nested telescoping arm 720 is also configured to include one or more slide stops to prevent telescoping arm 720 from sliding completely outside of rotating arm 710.

Nested telescoping arm 720 is further configured to include grabbing apparatus 500 on an end 724 of the telescoping arm 720 allowing the greatest extension of apparatus 500 from lid 700. Grabbing apparatus 500 may be a piece of hook tape affixed to the end 724 of telescoping arm 720, may be a hook integrally formed in end 724, or any other apparatus configured to adhere end 724 to an uppermost article of the stack of articles 300.

Figure 6:
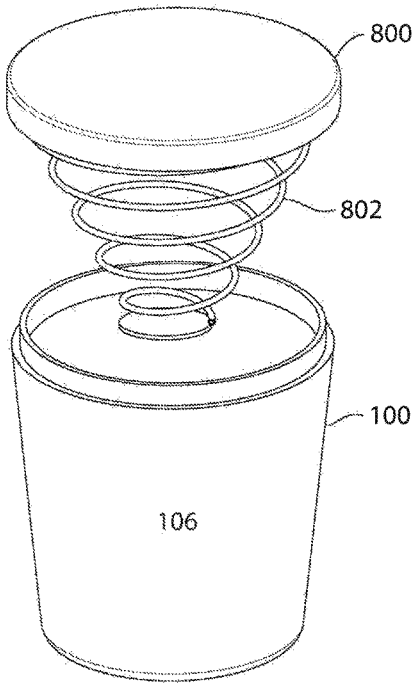
FIG. 6 is a partial isometric view of another alternative embodiment of the lid of FIG. 1 depicting a spring driven grabbing apparatus, according to an exemplary embodiment.

Referring now to FIG. 6, another alternative embodiment of a lid 800 for container 100 including a downward displacement apparatus 802 configured to assert force directing grabbing apparatus 500 into cavity 106 is shown, according to an exemplary embodiment. According to an exemplary embodiment, downward displacement apparatus 802 is spring affixed to an underside of lid 800 such that the spring extends into cavity 106 when lid 800 is in a closed position. According to an exemplary embodiment, downward displacement apparatus 802 is configured such that the maximum amount of displacement correlates with the height of container walls 104.

Figure 7A:
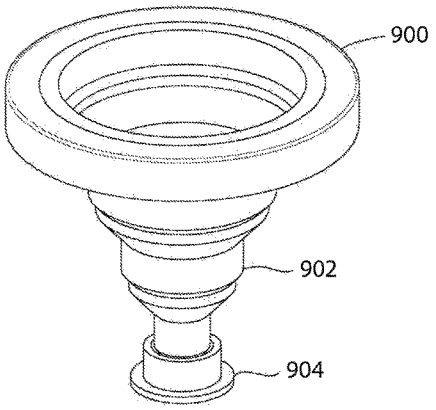
FIGS. 7A and 7B are partial isometric views of an alternative embodiment of the lid of FIG. 1 depicting an extendible bellows grabbing apparatus having a snap on ring tip, according to an exemplary embodiment.
Figure 7B:
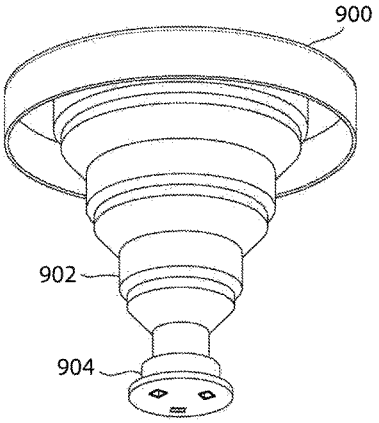

Referring now to FIGS. 7A and 7B, partial isometric views of an alternative embodiment of a container lid 900 including an extendible bellows 902 in an extended form configured to include a grabbing apparatus having a snap on ring tip 904, according to an exemplary embodiment. The snap on ring 904, shown in greater detail in FIGS. 8A and 8B, includes a bellows attachment 906 including a bellows attachment opening 908, a bellows attachment cavity 910, one or more bellows attachment anchors 912 extending inward from an inner wall of the bellows attachment 906 into the bellows attachment cavity 910. Snap on ring 904 further includes an integral article grabbing apparatus platform 914.

Snap on ring 904 may be formed from injection molded polypropylene, although one of ordinary skill in the art would appreciate that a variety of different formation technique and/or materials may be utilized to provide the advantages described herein. Advantageously, polypropylene provides a good moisture barrier, good chemical resistance, good resistance to damage and a cosmetically appealing appearance.

The bellows attachment anchors 912 may be configured to extend into the bellows attachment cavity 910 from any point at or below the bellows attachment opening 908 to a point less than the complete distance from the bellows attachment opening 908 to a base on the bellows attachment 906 along the inner wall of the bellows attachment 906. The distance from the termination of the bellows attachment opening 908 to a base on the bellows attachment 906 is configured to correspond to the bellows attachment protrusion 916 described below with reference to FIG. 9. Alternatively, bellows attachment anchors 912 may be configured as a partial or complete ring affixed to the inner wall of the bellows attachment 906 and configured to mate with a bellows attachment constriction 918, also described below with reference to FIG. 9.

Figure 8A:
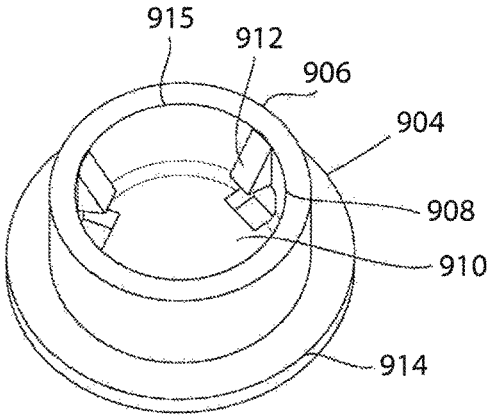
FIGS. 8A and 8B are a partial isometric view and a side view, respectively, of the snap on ring tip of FIGS. 7A and 7B, according to an exemplary embodiment.
Figure 8B:
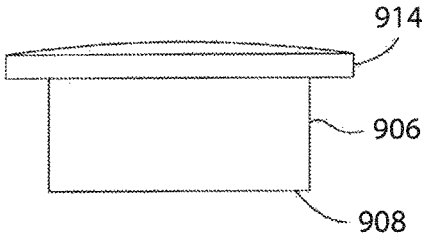

As shown in the embodiment of FIG. 8A, the bellows attachment anchors 912 may extend into the bellows attachment cavity 910 in an increasing distance dependent on the distance from the bellows attachment opening 908. Advantageously, the increasing distance configuration facilitates attachment of the snap on ring 904 by gradually compressing the bellows attachment protrusion 914 as it is moved from the bellows attachment opening 908 into the bellows attachment cavity 910 during an attachment operation. Upon reaching the termination of the bellows attachment anchors 912, the bellows attachment protrusion 914 will expand to an uncompressed state and the bellows attachment anchors 912 will extend into the bellows attachment constriction 916 such that the bellows attachment protrusion 914 will be held in place by an end of the bellows attachment anchors 912 opposite the end proximate to the bellows attachment opening 908. Advantageously, snap on ring 904 may be attached to the extendible bellows 912 without use of an adhesive that may degrade over time and/or contaminate the content of a container.

Apparatus platform 914 may be integrally formed with the bellows attachment 906 during an injection molding process. Platform 914 may further be configured to receive a VELCRO pad (not shown) on the side of the platform 914 opposite the bellows attachment 906. The VELCRO pad may be affixed to the platform 914 by an ultrasonic seal and/or other methods as are known in the art. Platform 914 may be provided with a large flat area to facilitate the use of a much larger piece of VELCRO, as well as enabled ultrasonic welding as a means of attaching the VELCRO to the platform 914 without adhesives. This adhesive-less platform 914 removes the need for adhesives that may present chemical compatibility challenges with the product materials, as well as additional complexity of using FDA approved adhesives.

Platform 914 may be configured to include one or more openings 915 through the platform 914 extending from the bellows attachment cavity 910 to the side of the platform 914 opposite the bellows attachment 906. Openings 915 allow air to exit from the bellows attachment cavity 910 as the bellows attachment constriction 916 is inserted into the bellows attachment cavity 910 to ease insertion of the bellows attachment protrusion 916. Further, openings 915 facilitate manufacturing in injection molding.

Figure 9:
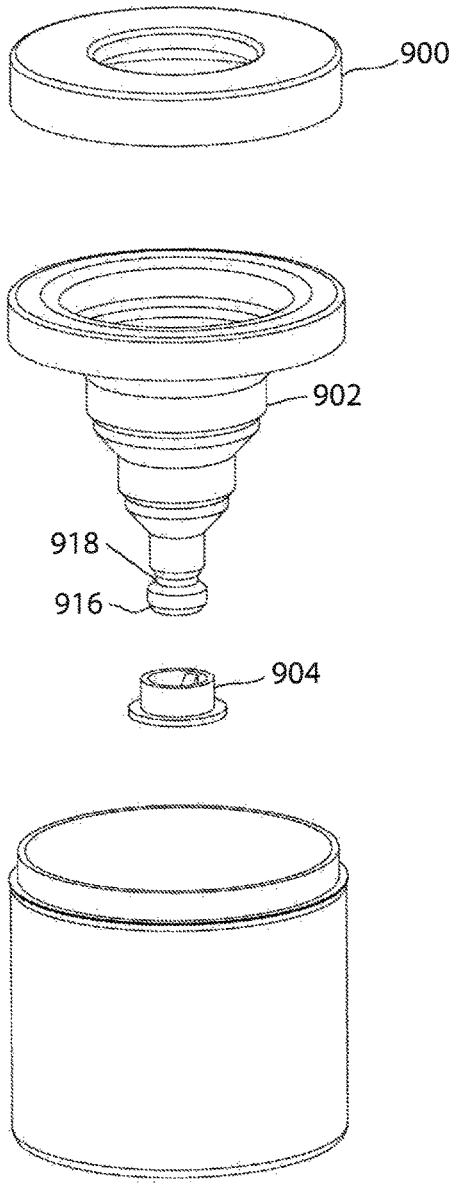
FIG. 9 is an exploded isometric view of an alternative embodiment of the container and lid of FIG. 1 where the integrated grabbing apparatus includes the snap on ring tip and extendible bellows of FIGS. 7A and 7B.

FIG. 9 is an exploded isometric view of an alternative embodiment of the container and lid of FIG. 1 where the integrated grabbing apparatus includes the snap on ring tip and extendible bellows of FIGS. 7A and 7B. FIG. 9 depicts the extendible bellows 902 including the bellows attachment protrusion 916 and the bellows attachment constriction 918. Although a particular sizes and shapes of the bellows attachment protrusion 916 and the bellows attachment constriction 918 are shown, it should be understood that are variety of sizes and shapes may be used dependent on the size, shape and configuration of the snap on ring 904 and its component parts. Preferably, the size and shape of the bellows attachment protrusion 916 is configured for a compression fitting in the bellows attachment cavity 910.

The present invention has been described in terms of one exemplary embodiment, and it is recognized that equivalents, alternatives, and modifications, aside from those expressly stated, are possible and within the scope of the appended claims.

We claim:

1. A lid for use with a container including stacked articles configured to facilitate the removal of an uppermost article from the stacked articles, comprising a grabbing apparatus configured to adhere to the uppermost article of the stacked articles; and a grabbing apparatus platform configured to support the grabbing apparatus, wherein the grabbing apparatus platform is configured to extend away from the lid when force is applied to a side of the grabbing apparatus platform external to the container, moving the grabbing apparatus away from the lid prior to the opening of the lid from the container, wherein the grabbing apparatus platform includes an extendible bellows.

2. The lid of claim 1, wherein the grabbing apparatus is positioned at a center position of the extendible bellows.

3. The lid of claim 1, wherein the extendible bellows is formed from thermoplastic elastomers.

4. The lid of claim 1, wherein the extendible bellows is configured to allow extension of the grabbing apparatus to a distance correlate to a height of the container.

5. The lid of claim 1, wherein the extendible bellows includes a snap on ring attachment anchoring the grabbing apparatus to the extendible bellows.

6. The lid of claim 5, wherein the snap on ring attachment includes an opening configured to receive a bellows attachment protrusion of the extendible bellows in a compression fit attachment.

7. The lid of claim 1, wherein the lid is configured to form a hermetic seal when in a closed position on the container including stacked articles.

8. A lid for use with a container including stacked articles configured to facilitate the removal of an uppermost article from the stacked articles, comprising a lid body;

a grabbing apparatus platform integrally formed within the lid body that is extendible prior to opening the lid from the container, the extension moving the grabbing apparatus platform from a first position proximate the lid body to a second position distal from the lid body when force is applied to a side of the grabbing apparatus platform external to the container, and a grabbing apparatus affixed to a portion of the grabbing apparatus platform that is farthest removed from the lid body in the second position and configured to adhere to the uppermost article of the stacked articles, wherein the grabbing apparatus platform includes an extendible bellows.

9. The lid of claim 8, wherein the grabbing apparatus is positioned at a center position of the extendible bellows.

10. The lid of claim 8, wherein the extendible bellows is formed from thermoplastic elastomers.

11. The lid of claim 8, wherein the extendible bellows is configured to allow extension of the grabbing apparatus to a distance correlate to a height of the container.

12. The lid of claim 8, wherein the extendible bellows includes a snap on ring attachment anchoring the grabbing apparatus to the extendible bellows.

13. The lid of claim 12, wherein the snap on ring attachment includes an opening configured to receive a bellows attachment protrusion of the extendible bellows in a compression fit attachment.

14. The lid of claim 8, wherein the lid is configured to form a hermetic seal when in a closed position on the container including stacked articles.

15. A hermetically sealed container and lid assembly configured to facilitate the removal of an uppermost article from an article stacked housed within the container, comprising a container body including a container base and at least one container wall; and a lid configured to form a hermetic seal with the container when in a closed position, the lid including a lid body, a grabbing apparatus platform, including an extendible bellows, integrally formed within the lid body that is extendible prior to opening the lid from the container, the extension moving the grabbing apparatus platform from a first position proximate the lid body to a second position distal from the lid body when force is applied to a side of the grabbing apparatus platform external to the container, and a grabbing apparatus affixed to a portion of the grabbing apparatus platform that is farthest removed from the lid body in the second position and configured to adhere to the uppermost article of the stacked articles.

16. The lid of claim 15, wherein the grabbing apparatus is configured to remove the uppermost article from the container when the lid is removed from the container.

* * * * *